US005378308A

United States Patent [19]

Thoms

[11] Patent Number: 5,378,308

[45] Date of Patent: Jan. 3, 1995

[54] ETCHANT DISTRIBUTION APPARATUS

[75] Inventor: Roland H. Thoms, Cortland, N.Y.

[73] Assignee: BMC Industries, Inc., Cortland, N.Y.

[21] Appl. No.: 973,679

[22] Filed: Nov. 9, 1992

[51] Int. Cl.[6] ..... C23F 1/00

[52] U.S. Cl. ..... 156/640; 156/644; 156/664; 156/345; 134/2; 134/15; 134/34; 134/64 R; 134/122 R; 134/129; 134/172; 134/199

[58] Field of Search ..... 156/644, 640, 664, 345, 156/665; 134/15, 64 R, 122 R, 129, 172, 199, 2, 41, 34

[56] References Cited

U.S. PATENT DOCUMENTS

| | | | |
|---|---|---|---|
| 2,203,480 | 6/1940 | Wood | 134/122 R |
| 3,468,362 | 9/1969 | Burkhardt et al. | 134/122 R |
| 3,502,519 | 3/1970 | White | 156/345 X |
| 3,756,898 | 0/1973 | Frantzer et al. | 156/345 |
| 3,788,912 | 1/1974 | Frantzer et al. | 156/640 |
| 4,251,956 | 2/1981 | Hirata et al. | 134/122 R |
| 4,852,595 | 8/1989 | Baier et al. | 134/144 |
| 4,985,111 | 1/1991 | Ketelhohn | 156/345 X |
| 4,999,079 | 3/1991 | Ash | 156/640 X |
| 5,169,477 | 12/1992 | Seki et al. | 156/345 |

FOREIGN PATENT DOCUMENTS

| | | | |
|---|---|---|---|
| 0037551 | 10/1981 | European Pat. Off. | C23F 1/04 |
| 0354266 | 2/1990 | European Pat. Off. | C23F 1/08 |
| 2347456 | 11/1977 | France | C23F 1/08 |
| 2001790 | 2/1971 | Germany | C23F 1/04 |
| 132780 | 5/1989 | Japan | 156/640 |
| 153081 | 6/1990 | Japan | 156/640 |
| 48087 | 2/1992 | Japan | 156/640 |

*Primary Examiner*—Thi Dang
*Attorney, Agent, or Firm*—Jacobson & Johnson

[57] ABSTRACT

An etching system for etching openings in a metal web including multiple etching station for etching a metal web from opposite sides with each of the etching stations including a set of first bank of oscillateable nozzles located in a first chamber in the etching station, with the first bank of oscillateable nozzles having predetermined spacings from one another, and operable for directing etchant at a first side of a metal web and a second bank of oscillateable nozzles located in a second chamber in the etching station, with the second bank of oscillateable nozzles having a predetermined spacing substantially identical to the first bank of oscillateable nozzles with the second set of oscillateable nozzles laterally offset from the first set of nozzles, so as not to spray on directly opposite regions located on the metal web with the banks of the nozzles in adjacent etching stations offset from each other with the oscillation axis of the nozzles is at an angle off normal so that etchant is sprayed in elliptical patterns on the metal web to more uniformly distribute etchant across the metal web.

11 Claims, 5 Drawing Sheets

ETCHANT DISTRIBUTION APPARATUS

FIELD OF THE INVENTION

This invention relates generally to etching metal webs and more particularly to more uniformly distributing etchant across the metal web to more accurately etch metal webs such as aperture masks.

BACKGROUND OF THE INVENTION

In the etching of metal webs, and, in particular, in the etching of metal webs from opposite sides it is difficult to uniformly control the distribution of etchant throughout the metal web. If holes are being etched in the metal web, the size and shape of the holes may vary substantially as a result of non-uniform etchant distribution.

One method used to more uniformly distribute the etchant is to place a first set of oscillateable etchant spray nozzles above the metal web and a second set of oscillateable etchant spray nozzles below the metal web, with both sets of oscillateable nozzles spraying etchant directly onto the metal web. The result is an etching process which has better dimensional controls, since the oscillating nozzles can more uniformly distribute the etchant on the metal web.

However, even with oscillating the nozzles, the spray patterns are not uniform, often resulting in uneven etching. The problem with uneven etching is that once breakthrough occurs in a metal web, that is, a hole has been formed in the web, etching proceeds at a much more rapid rate, since fresh etchant is continuously applied to the sides of the hole. The result is that a first pre-breakthrough etching rate exists, and a second post-breakthrough etching rate exists after the opening or hole is formed. Consequently, if all the holes in the metal are not begun to be enlarged at the same time the holes can become irregular and misshapen as a result of the different etching rates before and after breakthrough.

One of the goals of the present invention is to more uniformly distribute etchant to have the breakthrough occur at substantially the same time throughout the metal web. If the rate of etching proceeds at a constant rate throughout the metal web, one can accurately control the final dimensions of any openings formed in the metal web.

The present invention provides a process and apparatus for more uniformly distributing the etchant across the metal web in order to obtain breakthrough at substantially the same time throughout the metal web.

BRIEF SUMMARY OF THE INVENTION

An etching system for etching openings in a metal web including an etching station for etching a metal web from opposite sides with the etching system including a first bank of oscillateable nozzles located in a first chamber in the etching station, with the first bank of oscillateable nozzles having predetermined spacings from one another, and operable for directing etchant at a fast side of a metal web. The system includes a second bank of oscillateable nozzles located in a second chamber in the etching station, with the second bank of oscillateable nozzles having a predetermined spacing substantially identical to the first bank of oscillateable nozzles with the second set of oscillateable nozzles laterally offset from the first set of nozzles, so as not to spray on directly opposite regions located on the metal web. In addition the oscillation axis of the nozzles is off normal so that etchant is sprayed in elliptical patterns on the metal web.

DESCRIPTION OF THE PREFERRED EMBODIMENT

Figure 1:
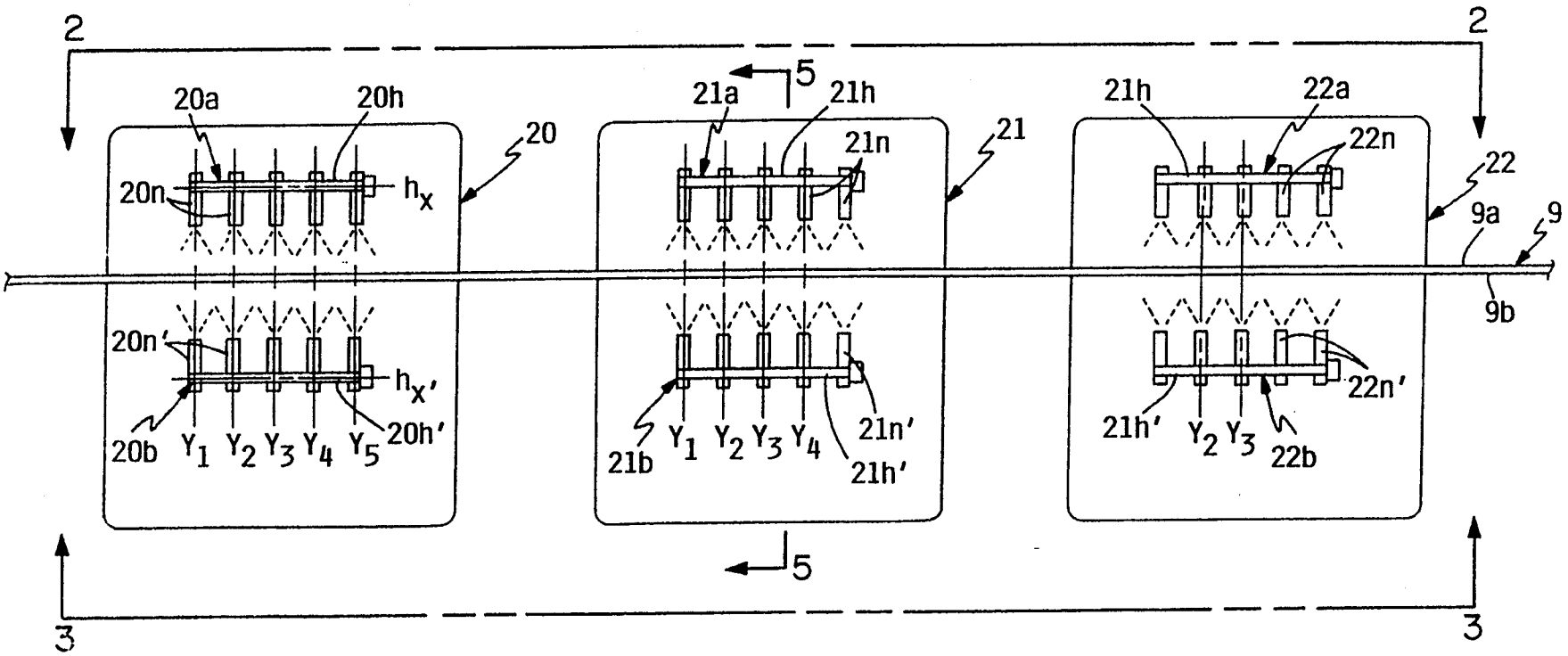
FIG. 1 is a partial schematic view of upper and lower etching chambers located proximate a moving web.

FIG. 1 shows a partial schematic side view of etching stations 20, 21 and 22, with a metal web 9 extending horizontally therethrough. As web 9 passes through the etching stations, each of the nozzles sprays etchant onto the metal web. Etching station 20 includes an upper etching chamber 20*a* and a lower etching chamber 20*b*. Etching chamber 20*a* includes upper header 20*h* with a plurality of nozzles 20*n* which are oscillateable about header axis $h_x$ Similarly, etching chamber 20*b* located on the underside of web 9 includes header 20*h'* which have nozzles 20*n'* which are oscillateable about header axis $h'_x$ through header 20*h'*. To illustrate the vertical spacing and alignment of the nozzles, FIG. 1 shows planes $y_1$, $y_2$, $y_3$, $y_4$ and $y_5$ drawn through lower nozzles 20*n'* and upper nozzles 20*n* which are located in etching chamber 20. Similarly, etching chambers 21 and 22 have the same vertical spacing and vertical alignment of etching nozzles located therein.

Figure 2:
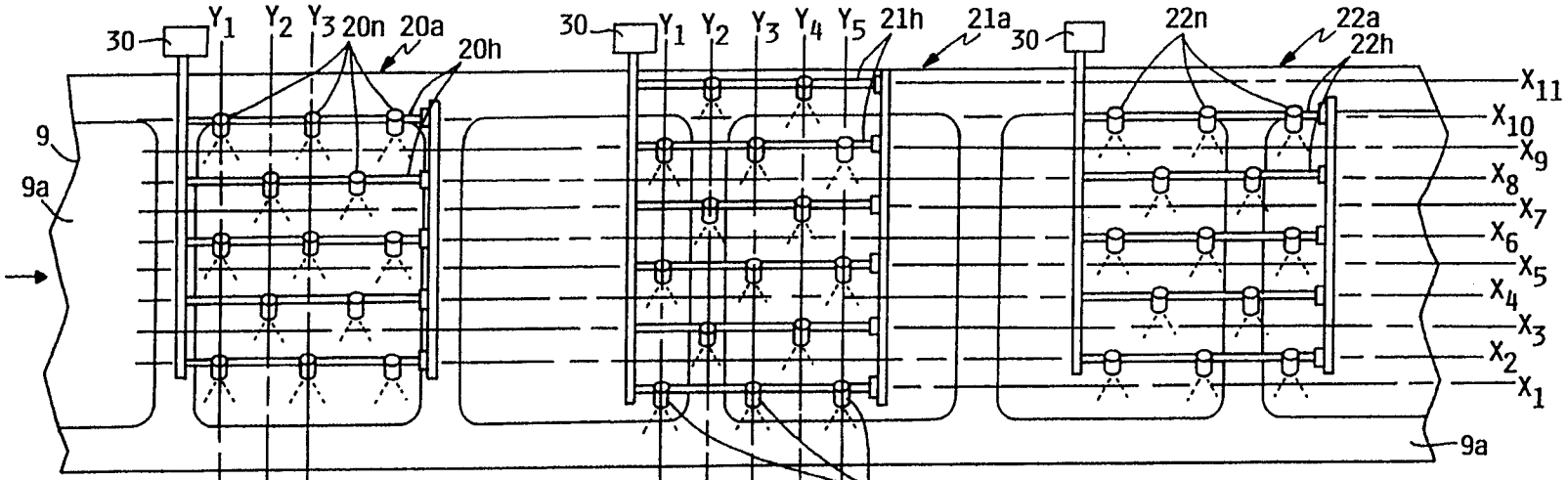
FIG. 2 is a view taken along lines 2—2 of FIG. 1.
Figure 3:
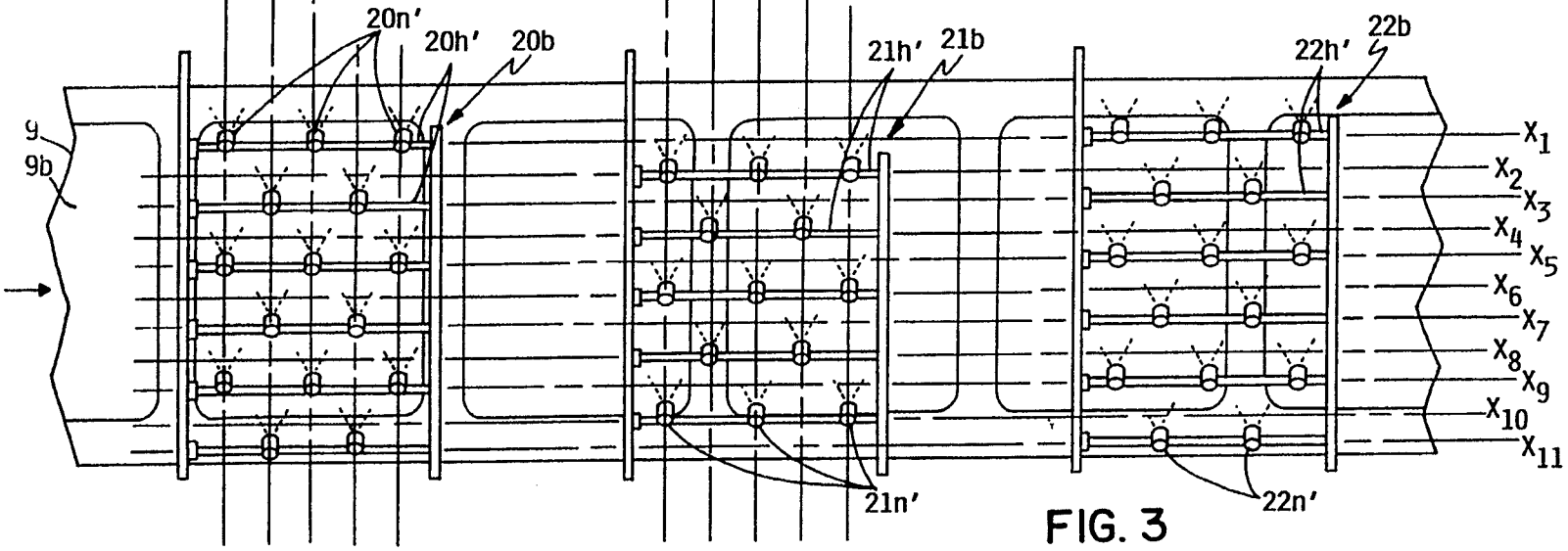
FIG. 3 is a view taken along lines 3—3 of FIG. 1.

FIGS. 2 and 3 illustrate in partial schematic the location and arrangement of the oscillating nozzles in each etching chamber. The bank of upper nozzle and the bank of lower nozzles are laterally offset from one another with the bank of nozzles in adjacent chambers also offset from adjacent banks of nozzles. Reference numeral 20*n* identifies the first set of upper oscillateable nozzles in chamber 20. The oscillateable nozzles 20*n* located on five headers 20*h* which are located in a spaced and parallel relationship to one another. Located on each of headers 20*h* are oscillateable nozzles 20*n* which direct etchant onto the top of web 9. A driving mechanism 30 oscillates headers 20*h* and nozzles 20*n* to spray etchant laterally across the top surface 9*a* of web 9.

Etching chamber 21*a* includes a second set of identical oscillateable upper nozzles 21*n*. In addition etching chamber 21 includes an extra row of nozzles. Similarly, etching chamber 22*a* includes a third set of identical oscillateable upper nozzles 22*n*. Oscillatable nozzles 20*n* and 22*n* are identical in their position and oscillation with respect to web 9, while oscillateable nozzles 21*n* are offset from the nozzles 20*n* and 22*n*. To illustrate the offset relationship of the upper nozzles, a series of parallel spaced reference planes $x_1$ through $x_{11}$ extend vertically through stations 20, 21 and 22. To illustrate the offset relationship of the upper nozzles with respect to the lower nozzles, reference should be made to FIG. 4 which shows the upper nozzles 20*n* in solid and the lower nozzles 20*n'* in phantom.

Figure 4:
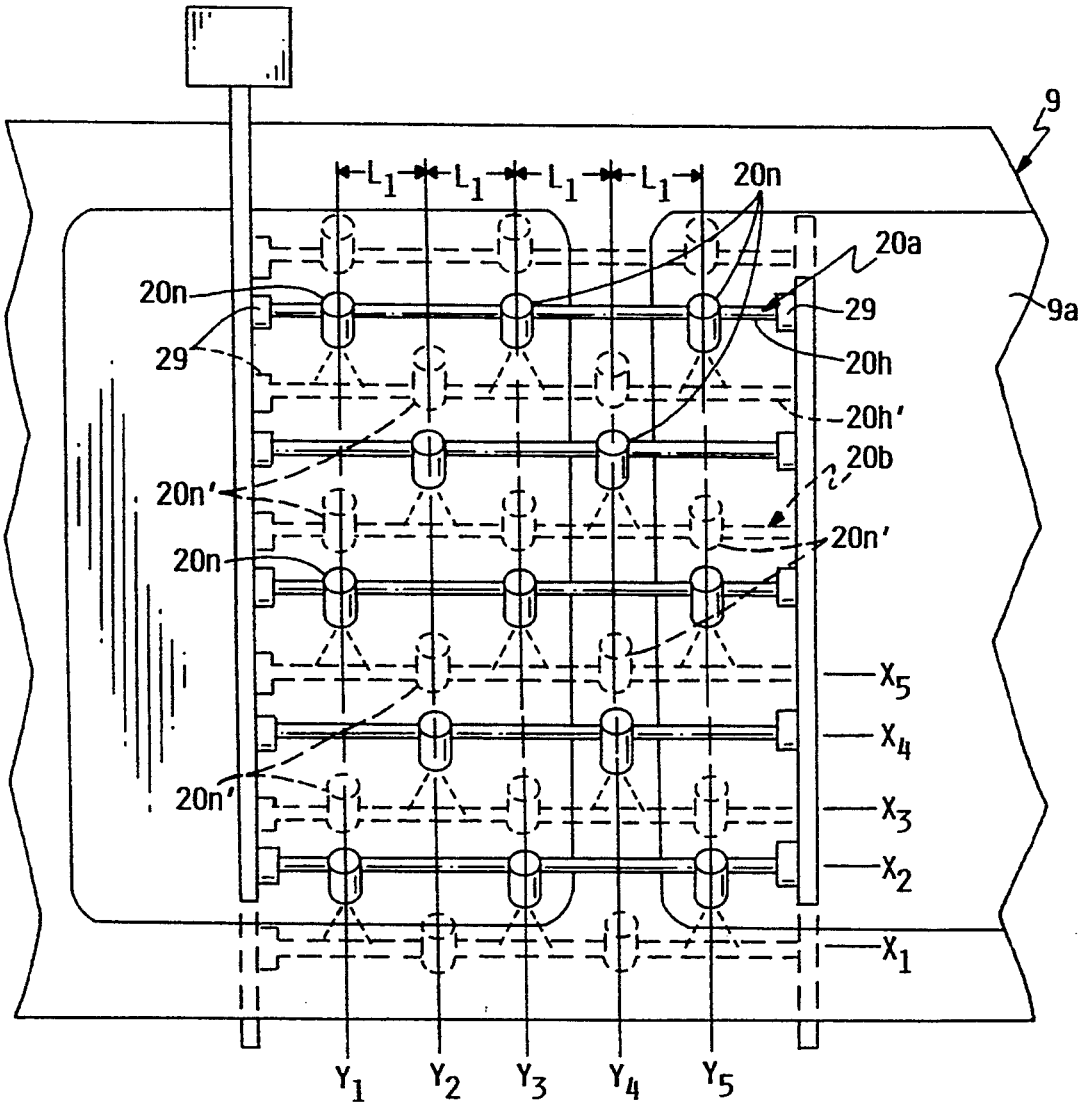
FIG. 4 shows a partial sectional view of an etching station upper spray nozzles and lower nozzles with the lower spray nozzles located in phantom.

FIG. 4 illustrates the lateral offset of the upper and lower banks of the oscillating nozzles which occurs in a single etching station. The bank of upper nozzles 20*n* located above web 9 is shown in solid lines, and a bank of lower oscillating nozzles 20*n'* is shown in dashed lines. Attention is called to the fact that each of the nozzles is located on equally spaced planes $y_1$ through $y_5$, which are perpendicular to web 9 and extend vertically downward from the top oscillating nozzles 20*n* through the lower oscillating nozzles 20*n'*. FIG. 4 illustrates the lateral offset of upper nozzles 20*n* from the lower nozzles 20*n'*. The upper nozzles 20*n* are located in even planes $x_2$, $x_4$, etc., while the lower nozzles 20*n'* are partial in odd planes, $x_1$, $x_3$, $x_5$, etc. From the drawing, it can be seen that lower nozzles 20*n'* are spaced midway between the upper nozzles 20*n* and staggered thereout, so as not to direct etchant on the opposed portions on the top and bottom of web 9. Thus, FIG. 4 illustrates that the grid pattern formed by the nozzles in the upper chamber and lower chamber of the same etching station are substantially identical except they are offset from one another so they do not spray etchant onto opposed regions on the opposite sides of web 9.

To illustrate the offsetting of nozzles in each etching station with respect to adjacent etching stations, reference should be made to FIGS. 2 and 3. FIGS. 2 and 3 are laid out so that the upper and lower views of etching chambers 20, 21 and 22 are in alignment with one another. To illustrate the offset of nozzles 20*n*, 21*n* and 22*n* in upper etching chamber 20, 21 and 22, reference planes have been drawn perpendicular to web 9 and are identified by $x_1$ through $x_{11}$. The position of planes $x_1$ through $x_{11}$ are also shown in FIG. 3 to show the position of the lower bank of nozzles 20*n'*, 21*n'* and 22*n'* with respect to the same reference planes.

FIG. 2 shows that the upper nozzles 20*n* and 22*n* are located in even reference planes $x_2$, $x_4$, $x_6$, $x_8$ and $x_{10}$, while the central station oscillating nozzles 21 oscillate about the odd planes which extend along planes $x_1$, $x_3$, $x_5$, $x_7$, $x_9$ and $x_{11}$. Thus, it is apparent that the nozzles in the top chambers of adjacent etching stations are offset from one another. Similarly, the nozzles in each of the bottom etching stations are also offset from one another. That is, the lower bank of nozzles 21*n'* oscillate about even planes $x_2$, $x_4$, $x_6$, $x_8$ and $x_{10}$, while nozzles 20*n'* in station 20*b* and nozzles 22*n'* in station 22*b* oscillate about the odd planes $x_1$, $x_3$, $x_5$, $x_7$, $x_9$ and $x_{11}$. Thus, is can be seen that not only the top and bottom banks of nozzles are offset from one another, but both the top and bottom banks of nozzles in adjacent etching stations are offset from one another, thus providing a double offset so that no one region of the web receives a same or similar spray etching from an adjacent etching station.

Figure 5:
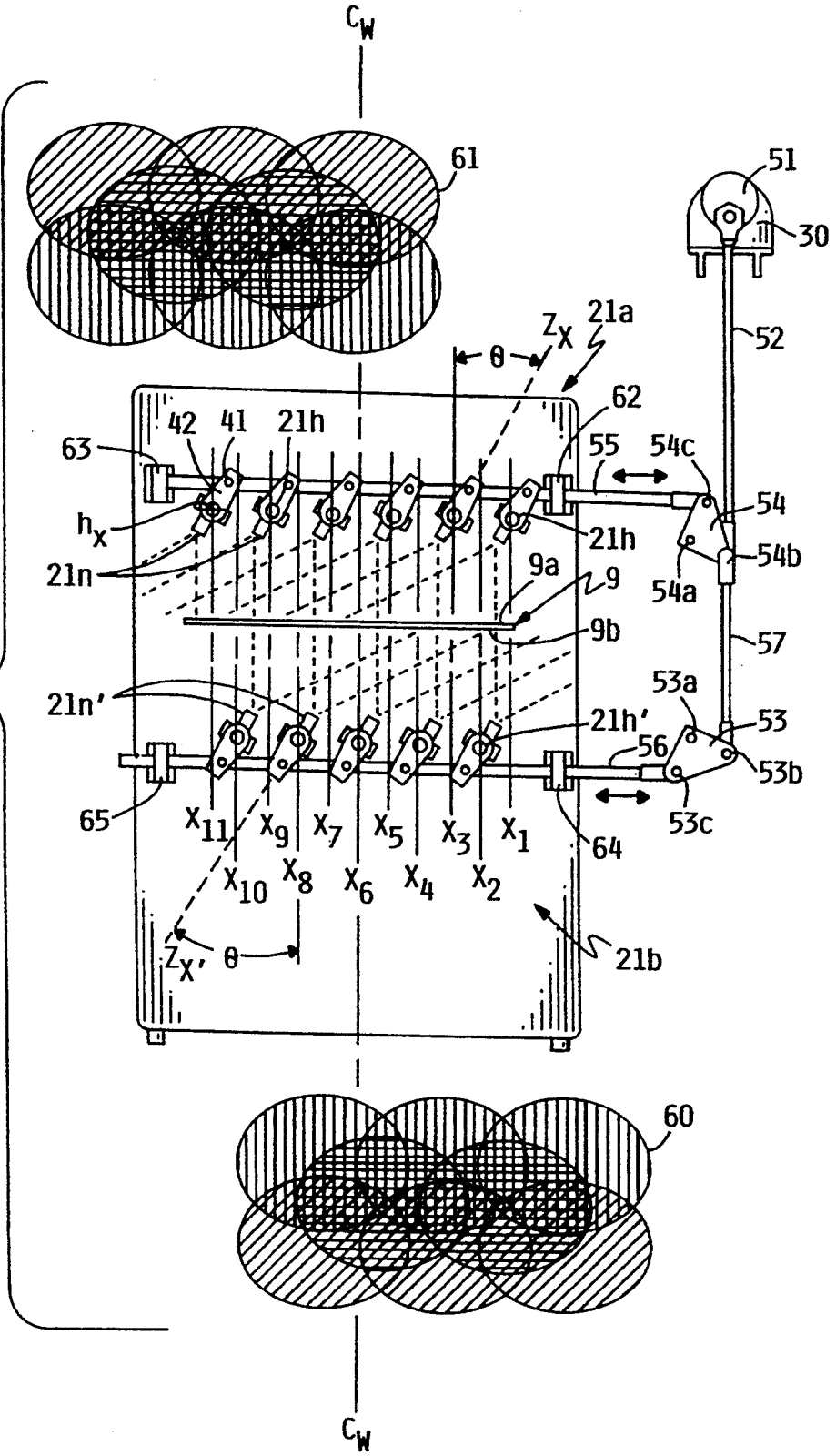
FIG. 5 shows a partial sectional view of the oscillating system of the present invention and a partial spray pattern as a result of the oscillation.

FIG. 5 shows a partial schematic taken along lines 5—5 of FIG. 1. FIG. 5 illustrates a mechanism for oscillating the upper and lower banks of nozzles as well as a partial nozzle spray pattern 61 on the upper side 9*a* of web 9 and a partial nozzle spray pattern 60 on the lower side 9*b* of web 9.

A further feature of the invention is the use of axis of oscillations of the nozzles which are offset a predetermined angle from a vertical axis to provide an elliptical type spray pattern on both the top and bottom of the mask.

To illustrate the relationship of the oscillating nozzles of the upper and lower chamber in a single etching station reference should be made to FIG. 5. Since each of the oscillating nozzles is identical in the upper and lower chamber, only one nozzles will be described with respect to its oscillation about an axis $h_x$ extending through its header.

Reference numeral 21*n* identifies an oscillating nozzles having a pivot pin 41 and an arm 42. Oscillating nozzle 21*n* is located on header 21*h* and oscillates about header axis $h_x$. When the oscillating nozzles 21 n are operating, a motor 30 drives a crank 51 which connects to arms 52 and 57. Arm 52 connects to upper pivotal plate 54 and lower pivotal plate 53. Pivotal plate 54 pivots about pivot pin 54*a*, and, similarly, lower pivot plate 53 pivots about pivot pin 53*a*. The back and forth movement of arm 52 moves arm 57 which is pivotally connected to plate 54 by pivot pin 54*b* and to plate 53 by pivot pin 53*b*. Since pivot pins 53*a* and 54*a* are fixed, pivot plate 54 forces member 55 to oscillate back and forth in a direction indicated by the arrows. Similarly, pivot plate 53 forces member 56 to oscillate back and forth in the direction indicated by arrows. As a result of the driving action of motor 30, the upper nozzles 21*n* which are connected to member 55 oscillate about a non-vertical axis x. Similarly, the lower nozzles oscillate about a lower non-vertical axis $z'_x$. which is parallel to axis $z_x$. As the upper and lower nozzles oscillate, they spray etchant onto web 9. The upper overlapping spray pattern of three adjacent rows of nozzles is indicated by reference numeral 61, and comprises a plurality of elliptical shaped regions. Similarly, the lower overlapping spray pattern of three adjacent rows of nozzles is indicated by reference numeral 60 on the underside of web 9 and also comprises a plurality of elliptical shaped regions which, as shown in the drawing, are biased to the right, while the spray pattern on top is biased to the left. While the spray pattern in adjacent station is substantially identical, the spray pattern in adjacent station is offset since the nozzles in adjacent station are offset from one another.

The elliptical shaped regions 60 and 61 result from the axis $z_x$ of each of the nozzles being offset at an angle of approximately 33 degrees from a line extending perpendicular to web surface 9. Reference letter theta on the drawing indicates the offset angle. In the preferred embodiment it is preferred that the nozzles are spaced about five to twelve inches from the metal web and that the nozzles oscillate within frequency range of 30 to 60 cycles per minute an have a maximum oscillation angle about axis $z_{x'}$ or axis $z_x$ which ranges from about 10 degrees to 30 degrees on each side of the axis $z_{x'}$ or axis $z_x$.

Figure 6:
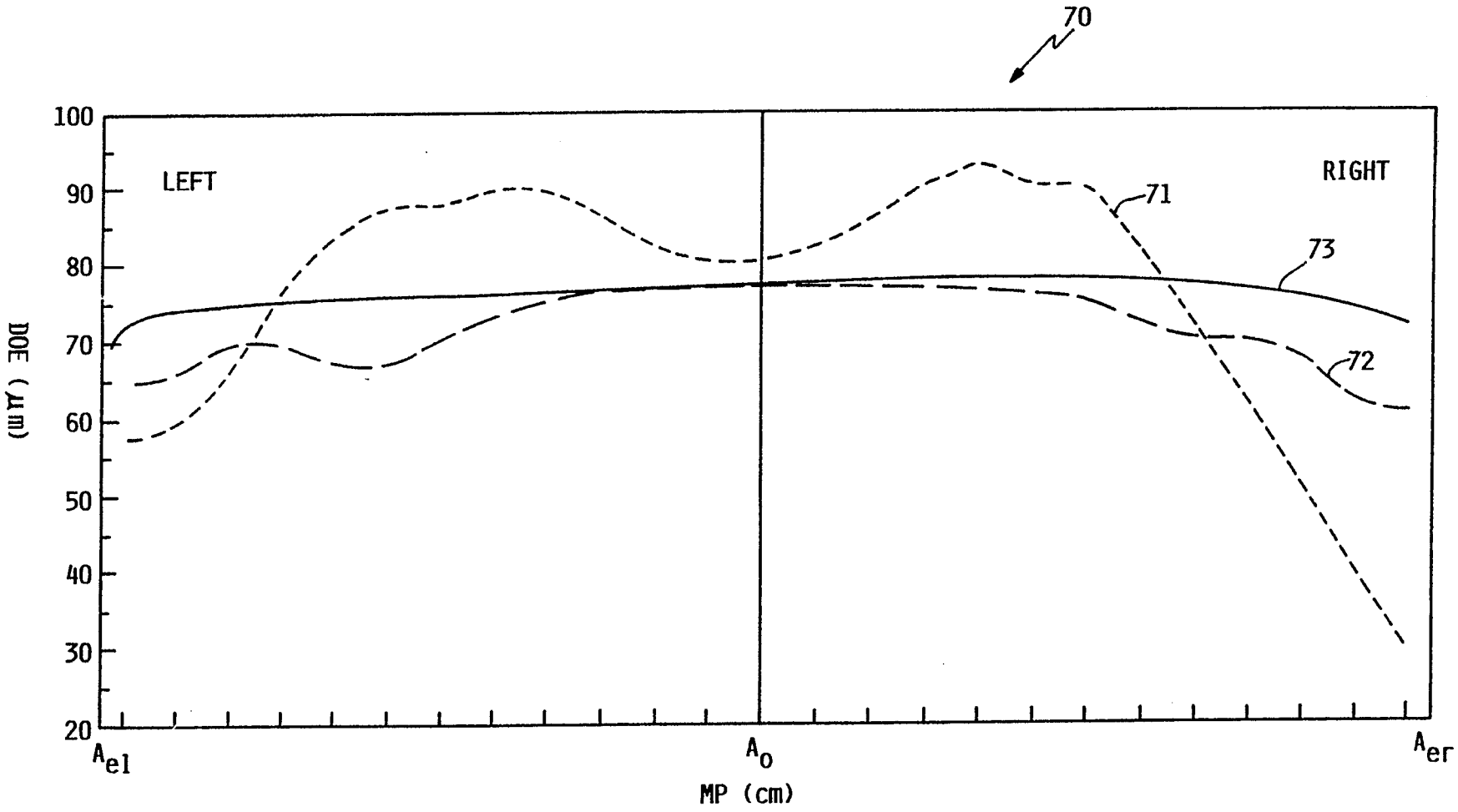
FIG. 6 shows a graph representing the depth of etch as a function of mask position for various types of etchant distribution systems.

To illustrate the depth of etch on a metal web under different oscillating spray conditions, reference should be made to FIG. 6. The vertical axis identifies the depth of etch, while the horizontal axis identifies the lateral position across a shadow mask. The reference $A_o$ indicates the center of the mask, $A_{el}$ indicates the left edge of the mask, indicates the right edge of the mask.

Graph 71 identifies the variation of depth of etch when stationary nozzles are used. Note the depth of etch varies considerably from one side of the mask to the other side. Under these conditions, breakthrough would occur throughout the mask at different times.

Graph 72 identifies the variation of depth of etch from one side of the mask to the other side of the mask in prior art systems. Note that the depth of etch, although varying considerably from one side to the other, is better than if stationary nozzles were used.

Graph 73 identifies the variation of depth of nozzle depth of edge from one side of the mask to the other side with the etchant distribution system of present invention. Note the depth of etch remains substantially constant from one side of the mask to the other side. The result is that, when etching a metal web from opposite sides, the goal of obtaining a breakthrough at virtually identical times will be substantially achieved. With breakthrough occurring in the mask at virtually the same time, one is assured that, although different etching rates exist prior to and after breakthrough, the etching at varying regions across the mask will be substantially the same so that the final dimensions of the aperture can be more accurately controlled.

What is claimed is:

1. The method of spray etching a metal web to more uniformly distribute etchant on the metal web and more uniformly etch the depth of holes in the metal web comprising:

establishing a first grid pattern of oscillateable nozzles for etching the metal web from one side of a metal web, establishing a second grid pattern of oscillateable nozzles for etching the metal web from the one side of the metal web, said second grid pattern offset from said first grid pattern;

establishing a third grid pattern of oscillateable nozzles for etching the metal from the one side of the metal web with said third grid pattern offset from said second grid pattern with each of said nozzles of the first grid pattern, the second grid pattern and the third grid pattern having an axis of oscillation located at an acute angle from a plane extending substantially perpendicular to the one side of the metal web; and oscillating each of nozzles of the first grid pattern, the second grid pattern and third grid pattern about their respective said axis of oscillation at a cone angle that provides an elliptical shaped etchant spray pattern on the one side of the metal web which is offset from a plane extending perpendicular through the nozzle spraying the elliptical shaped etchant pattern on the one side of the metal web and the metal web to maintain a substantially uniform etching rate across the one side of the metal web as holes are etched in the one side of the metal web.

2. The method of claim 1 including:

establishing a fourth grid pattern of oscillating nozzles for etching the metal web from the opposite side of the metal web, said fourth grid pattern of oscillateable nozzles offset from said first grid pattern of oscillating nozzles;

establishing a fifth grid pattern of oscillating nozzles for etching the metal web from the opposite side of the metal web, said fifth grid pattern offset from the fourth grid pattern of oscillating nozzles;

establishing a sixth grid pattern of oscillateable nozzles for etching the metal web from the opposite side of the metal web; said sixth grid pattern offset from said fifth grid pattern of oscillating nozzles; and simultaneously oscillating all the nozzles while spraying etchant from the oscillateable nozzles onto both sides of the metal web so that the cumulative amount of etchant sprayed on the the metal web maintain a substantially uniform etching rate across both sides of the metal web as holes are etched in the metal web.

3. The method of claim 1 including the step of oscillating each of the nozzles over an angle of approximately 60 degrees with the axis of oscillation located at an angle of approximately 33 degrees to an axis perpendicular to the surface of the metal web.

4. An etching system for etching through-openings in a metal web while maintaining a substantially uniform etching rate across the metal web comprising:

an etching station for etching a metal web from opposite sides comprising:

a first bank of oscillateable nozzles located in a first chamber in said etching station, said first bank of oscillateable nozzles having predetermined spacings from one another, said first bank of oscillateable nozzles operable for directing etchant at a first side of a metal web with each of said nozzles having an axis of oscillation located at an acute angle from a plane extending substantially perpendicular to one side of the metal web, and with each of said nozzles oscillating about their respective said axis of oscillation at a cone angle that provides an elliptical shaped etchant spray pattern on the metal web which is offset from a plane extending perpendicular through the nozzle spraying the elliptical shaped etchant pattern and the metal web:

and a second bank of oscillateable nozzles located in a second chamber in said etching station, said second bank of oscillateable nozzles having a predetermined spacing substantially identical to said first bank of oscillateable nozzles with said second set of oscillateable nozzles laterally offset from said first set of nozzles, so as not to spray on directly opposite regions located on the metal web with each of said nozzles of said second bank of oscillateable nozzles having an axis of oscillation located at an acute angle from the plane extending substantially perpendicular to one side of the metal web, and with each of said nozzles of said second bank of oscillateable nozzles oscillating about their respective said axis of oscillation at a cone angle that provides an elliptical shaped etchant spray pattern on the metal web which is offset from a plane extending perpendicular through the nozzle of the second bank spraying the elliptical shaped etchant pattern and the metal web so that etchant from said first bank of oscillatable nozzles and the etchant from said second bank of oscillateable nozzles coact to etch the metal web at a substantially uniform rate across the metal web.

5. The etching system of claim 4 including a second etching station, said second etching station located proximate said first etching station, said second etching station including a third bank of oscillateable nozzles located in a first chamber in said second etching station, said third bank of oscillateable nozzles having a predetermined spacing from each other, substantially identical to said first bank of nozzles and said second bank of oscillateable nozzles, said third bank of oscillateable nozzles located in offset relationship to said first bank of oscillateable nozzles but not with respect to said second bank of oscillateable nozzles.

6. The etching system of claim 5 including a fourth bank of oscillateable nozzles located in a second chamber in said second etching station, said fourth bank of oscillateable nozzles having a predetermined spacing substantially identical to said first bank of oscillateable nozzles with said fourth set of oscillateable nozzles laterally offset from said second bank of oscillateable nozzles and said third bank of oscillateable nozzles but not with respect to said first bank of oscillateable nozzles.

7. The etching system of claim 4 wherein one bank of nozzles in the etching station includes includes an even number of headers and said other bank of nozzles includes an odd number of headers.

8. The etching system of claim 4 wherein said first bank of nozzles are offset halfway between said second bank of nozzles.

9. The etching system of claim 6 wherein said first bank of nozzles and said second bank of nozzles have an axis of oscillation of about 33 degrees from a normal to the surface of the metal web.

10. The etching system of claim 4 wherein the acute axis angle of oscillation of said nozzles is about 33 degrees from the plane extending perpendicular to one side of the metal web.

11. The etching system of claim 4 wherein said nozzles oscillate about a maximum cone angle of approximately 60 degrees.

* * * * *

UNITED STATES PATENT AND TRADEMARK OFFICE

CERTIFICATE OF CORRECTION

PATENT NO. : 5,378,308

DATED : January 3, 1995

INVENTOR(S) : ROLAND H. THOMS

It is certified that error appears in the above-indentified patent and that said Letters Patent is hereby corrected as shown below:

Col. 1, line 61, delete "fast", insert --first--

Signed and Sealed this

Eleventh Day of April, 1995

*Attest:*

Bruce Lehman

BRUCE LEHMAN

*Attesting Officer*

*Commissioner of Patents and Trademarks*